US009626907B2

(12) United States Patent
Xie et al.

(10) Patent No.: US 9,626,907 B2
(45) Date of Patent: Apr. 18, 2017

(54) DRIVING CIRCUIT AND ORGANIC LIGHT EMITTING DISPLAY APPARATUS

(71) Applicant: BOE TECHNOLOGY GROUP CO., LTD., Beijing (CN)

(72) Inventors: Hongjun Xie, Beijing (CN); Weiqiang Zhang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 19 days.

(21) Appl. No.: 14/653,973

(22) PCT Filed: Sep. 28, 2014

(86) PCT No.: PCT/CN2014/087632
§ 371 (c)(1),
(2) Date: Jun. 19, 2015

(87) PCT Pub. No.: WO2015/180341
PCT Pub. Date: Dec. 3, 2015

(65) Prior Publication Data

US 2016/0253966 A1 Sep. 1, 2016

(30) Foreign Application Priority Data

May 30, 2014 (CN) ..... 2014 1 0240219

(51) Int. Cl.
*G09G 3/3233* (2016.01)
*G09G 3/3258* (2016.01)
*G09G 3/3225* (2016.01)

(52) U.S. Cl.
CPC ..... *G09G 3/3233* (2013.01); *G09G 3/3225* (2013.01); *G09G 3/3258* (2013.01);
(Continued)

(58) Field of Classification Search
CPC ..... G09G 2310/08; G09G 2320/0257; G09G 2330/12; G09G 3/3233; G09G 3/3258;
(Continued)

(56) References Cited

U.S. PATENT DOCUMENTS 6,476,590 B2 11/2002 Chou
2007/0109290 A1* 5/2007 Lee ..... G09G 5/003 345/211

(Continued)

FOREIGN PATENT DOCUMENTS

CN 1588528 A 3/2005
CN 1920925 A 2/2007

(Continued)

OTHER PUBLICATIONS

International Search Report of PCT/CN2014/087632 in Chinese with English translation, mailed Mar. 2, 2015.

(Continued)

*Primary Examiner* — Dmitriy Bolotin
(74) *Attorney, Agent, or Firm* — Collard & Roe, P.C.

(57) ABSTRACT

There are disclosed a driving circuit of an organic light emitting display panel and an organic light emitting display apparatus. The driving circuit comprises: a power supply detection circuit configured to detect an operating state of an external input power supply, send a normal signal of power supply detection when it is determined that the external input power supply is in a normal state, and send a abnormal signal of power supply detection when it is determined that the external input power supply is in an abnormal state; a clock control circuit configured to convert a received video data into image data recognizable by the organic light emitting display panel and then output it to the organic light emitting display panel when the normal signal of power supply detection sent by the power supply detection circuit
(Continued)

is received, and output image data of black picture to the organic light emitting display panel when the abnormal signal power supply detection sent by the power supply detection circuit is received. In this way, pixel charges accumulated on respective display pixels can be released, which avoids transistors inside the display pixels from producing stress, and finally avoids occurrence of shutdown image sticking due to power-down.

16 Claims, 2 Drawing Sheets

(52) U.S. Cl.
CPC . *G09G 2310/08* (2013.01); *G09G 2320/0257* (2013.01); *G09G 2330/027* (2013.01); *G09G 2330/04* (2013.01); *G09G 2330/12* (2013.01)

(58) Field of Classification Search
CPC ..... G09G 3/3225; G09G 2330/027; G09G 2330/04
USPC ..... 345/76, 213
See application file for complete search history.

(56) References Cited

U.S. PATENT DOCUMENTS

2008/0122758 A1* 5/2008 Kim ..... G09G 3/3216 345/76
2008/0129903 A1 6/2008 Hong et al.
2008/0165099 A1 7/2008 Cho et al.
2010/0188318 A1* 7/2010 Ishii ..... G09G 3/3283 345/76
2011/0050747 A1* 3/2011 Ishii ..... G09G 3/3208 345/690
2014/0084792 A1* 3/2014 Oh ..... H05B 37/02 315/120

FOREIGN PATENT DOCUMENTS

CN 102103835 A 6/2011
TW 554322 B 9/2003

OTHER PUBLICATIONS

Notice of Transmittal of the International Search Report of PCT/CN2014/087632 in Chinese, mailed Mar. 2, 2015.
Written Opinion of the International Searching Authority of PCT/CN2014/087632 in Chinese with English translation mailed Mar. 4, 2015.
First Chinese Office Action of Chinese Application No. 201410240219.9, mailed Jan. 14, 2015 with English translation.
Second Chinese Office Action of Chinese Application No. 201410240219.9, mailed May 26, 2015 with English translation.
Third Chinese Office Action of Chinese Application No. 201410240219.9, mailed Jun. 29, 2015 with English translation.

* cited by examiner

DRIVING CIRCUIT AND ORGANIC LIGHT EMITTING DISPLAY APPARATUS

CROSS REFERENCE TO RELATED APPLICATIONS

This application is the National Stage of PCT/CN2014/087632 filed on Sep. 28, 2014, which claims priority under 35 U.S.C. §119 of Chinese Application No. 201410240219.9 filed on May 30, 2014, the disclosure of which is incorporated by reference.

TECHNICAL FIELD

The present disclosure relates to a driving circuit of an organic light emitting display panel and an organic light emitting display apparatus.

BACKGROUND

An organic light emitting diode (OLED) is a hot topic in the flat panel display research field. Compared with a liquid crystal display, OLED has advantages of low power consumption, low production cost, self-luminescent, wide view angle and fast response speed and so on. At present, in the display field of mobile phone, PDA, and digital camera and the like, OLED has taken place of the traditional LCD display screen.

A user's voluntary shutdown or an abnormal shutdown caused by a sudden power-down may occur to the existing OLED in the process of using. In the case of the sudden power-down, there exist in the OLED display panel the phenomenon that pixel charges remained inside respective display pixels to make transistors inside the display pixels produce stress, which causes that images stagnate and fade away gradually within a short period of time after the display screen is powered down. This abnormal phenomenon becomes shutdown image sticking, and the shutdown image sticking would leave a mark inside the display screen. Residual images may be viewed when the display screen is power on next time, which influences the user's visual perception.

Therefore, how to eliminate the shutdown image sticking phenomenon when OLED is shut down abnormally is a problem urgently to be solved in the OLED display field.

SUMMARY

Given that, there provide in embodiments of the present disclosure a driving circuit of an organic light emitting display panel and an organic light emitting display apparatus, which are used to solve the problem of shutdown image sticking that occurs when the existing OLED is shut down abnormally.

According to one aspect of the present disclosure, there is provided a driving circuit of an organic light emitting display panel, comprising:

a power supply detection circuit configured to detect an operating state of an external input power supply, send a normal signal of power supply detection when it is determined that the external input power supply is in a normal state, and send a abnormal signal of power supply detection when it is determined that the external input power supply is in an abnormal state;

a clock control circuit configured to convert a received video data into image data recognizable by the organic light emitting display panel and then output it to the organic light emitting display panel when the normal signal of power supply detection sent by the power supply detection circuit is received, and output image data of black picture to the organic light emitting display panel when the abnormal signal of power supply detection sent by the power supply detection circuit is received.

In the driving circuit of the above organic light emitting display panel of the embodiment of the present disclosure, it is indicated that voltage of the external input power supply starts to be powered down when the power supply detection circuit detects that the operating state of the external input power supply is the abnormal state. Due to hysteresis of power supply of the driving circuit, the driving circuit will be maintained operating normally for a short period of time, and at this time the power supply detection circuit outputs the abnormal signal of power supply detection to the clock control circuit. The clock control circuit changes from sending normal image data to the organic light emitting display panel into sending black picture image data to the organic light emitting display panel after receiving the abnormal signal. The organic light emitting display panel can release pixel charges accumulated on respective display pixels when displaying the black picture image, which avoids transistors inside the display pixels from producing stress, and finally avoids occurrence of shutdown image sticking due to power-down.

In an alternative implementation, in the above driving circuit provided in the embodiment of the present disclosure, the power supply detection circuit can comprise:

an input unit configured to obtain an alternating current voltage of the external input power supply and perform rectifying process on the external input power supply;

an detection unit configured to detect an operating state of the alternating current voltage of the external input power supply processed by the input unit;

an output unit configured to send the normal signal of power supply detection to the clock control circuit when the detection unit determines that the external input power supply is in the normal state, and send the abnormal signal of power supply detection to the clock control circuit when the detection unit determines that the external input power supply is in the abnormal state.

In an alternative implementation, in the above driving circuit of the embodiment of the present disclosure, the detection unit can be configured to determine that the external input power supply is in the normal state when it is determined that a ratio of a voltage value of the external input power supply to a reference voltage value is greater than a predetermined threshold value, and determine that the external input power supply is in the abnormal state when it is determined that a ratio of a voltage value of the external input power supply to a reference voltage value is not greater than the predetermined threshold value.

In an alternative implementation, in the above driving circuit of the embodiment of the present disclosure, the predetermined threshold value set in the detection unit is 0.6-0.85.

In an alternative implementation, in the above driving circuit of the embodiment of the present disclosure, the normal signal of power supply detection and the abnormal signal of power supply detection output by the output unit are LVTTL signals.

In an alternative implementation, in the above driving circuit of the embodiment of the present disclosure, it further comprises: a power supply circuit configured to provide power supply for respective circuits in the driving circuit after converting the received alternating current voltage of the external input power supply into a direct current voltage required by the respective circuits.

In an alternative implementation, in the above driving circuit of the embodiment of the present disclosure, the power supply detection circuit is integrated in the power supply circuit.

In an alternative implementation, in the above driving circuit of the embodiment of the present disclosure, it further comprises: a system circuit configured to receive an external video signal, convert the external video signal into video data and then output it to the clock control circuit.

According to another aspect, there is provided an organic light emitting display apparatus comprising the organic light emitting display panel and the driving circuit of the organic light emitting display panel of the embodiments of the present disclosure.

DETAILED DESCRIPTION

Specific implementations of a driving circuit of an organic light emitting display panel and an organic light emitting display apparatus in embodiments of the present disclosure will be described in detail below by combining with the accompanying figures.

Figure 1:
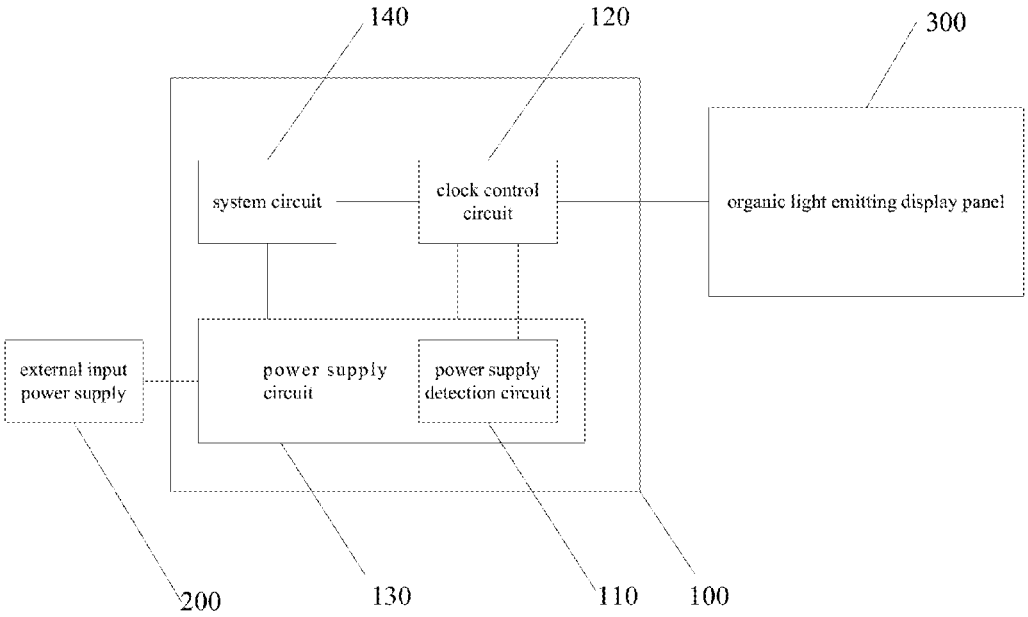
FIG. 1 is a schematic diagram of a structure of a driving circuit in an embodiment of the present disclosure.

FIG. 1 shows schematically a driving circuit 100 of an organic light emitting display panel in an embodiment of the present disclosure. As shown in FIG. 1, the driving circuit 100 comprises: a power supply detection circuit 110 and a clock control circuit 120.

The power supply detection circuit 110 is configured to detect an operating state of an external input power supply 200, sends a normal signal of power supply detection to the clock control circuit 120 when it is determined that the external input power supply 200 is in a normal state, and sends a abnormal signal of power supply detection to the clock control circuit 120 when it is determined that the external input power supply 200 is in an abnormal state.

The clock control circuit 120 is configured to convert a received video data into image data that can be recognized by an organic light emitting display panel 300 and then output it to the organic light emitting display panel 300 when the normal signal of power supply detection is received, and output black picture image data to the organic light emitting display panel 300 when the abnormal signal of power supply detection is received.

In the driving circuit of the organic light emitting display panel in the embodiment of the present disclosure as shown in FIG. 1, it is indicated that voltage of the external input power supply 200 starts to be powered down when the power supply detection circuit 110 detects that the operating state of the external input power supply 200 is the abnormal state. Due to the hysteresis of power supply of the power supply circuit in the driving circuit 100, the driving circuit 100 can still be maintained operating normally for a short period of time. Now, the power supply detection circuit 100 outputs the abnormal signal of power supply detection to the clock control circuit 120. The clock control circuit 120 changes from sending normal image data to the organic light emitting display panel 300 into sending black picture image data to the organic light emitting display panel 300 after having received the abnormal signal. The organic light emitting display panel 300 can release pixel charges accumulated on respective display pixels when displaying the black picture image, which avoids transistors inside the display pixels from producing stress, and finally avoids occurrence of shutdown image sticking due to the power-down.

Figure 2:
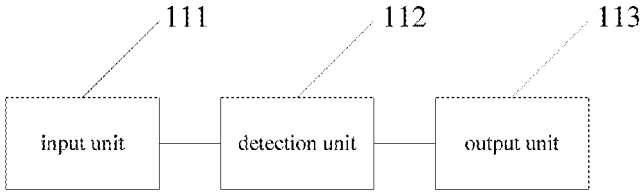
FIG. 2 is a schematic diagram of a structure of a power supply detection circuit in the driving circuit in an embodiment of the present disclosure.

FIG. 2 schematically shows the structure of the power supply detection circuit 110 in the driving circuit 100 in the embodiment of the present disclosure. As shown in FIG. 2, the power supply detection circuit 110 can comprise:

an input unit 111 configured to obtain an alternating current voltage of the external input power supply, and perform rectifying process on the alternating current voltage of the external input power supply;

an detection unit 112 configured to detect an operating state of the alternating current voltage of the external input power supply 200 processed by the input unit 111;

an output unit 113 configured to send the normal signal of power supply detection to the clock control circuit 120 when the detection unit 112 determines that the external input power supply 200 is in the normal state, and send the abnormal signal of power supply detection to the clock control circuit 120 when the detection unit 112 determines that the external input power supply 200 is in the abnormal state.

Alternatively, the normal signal of power supply detection and the abnormal signal of power supply detection outputted by the output unit 113 in the power supply detection circuit 110 can adopt LVTTL signals, and generally adopt LVTTL (Low Voltage TTL) signals of 3.3V in a level standard. For example, a high level LVTTL signal can be used as the normal signal of power supply detection and a low level LVTTL signal can be used as the abnormal signal of power supply detection. The high level LVTTL signal herein refers to LVTTL signals of 2.2V-3.3V, and the low level LVTTL signal herein refers to LVTTL signals of 0-0.9V.

Exemplarily, when the detection unit 112 in the power supply detection circuit 110 detects the operating state of the alternating current voltage of the external input power supply 200 processed by the input unit 111, it can determine whether the external input power supply 200 operates normally in a manner of comparing a voltage value of the external input power supply 200 with a reference value. For example, it can be determined that the external input power supply 200 is in the normal state when it is determined that a ratio of the voltage value of the external input power supply 200 to the reference voltage value is greater than a predetermined threshold value; and it can be determined that the external input power supply 200 is in the abnormal state when it is determined that a ratio of the voltage value of the external input power supply 200 to the reference voltage value is not greater than the predetermined threshold value.

Exemplarily, the predetermined threshold value set in the detection unit 112 can be generally set between 0.6 and 0.85. For example, the alternating current voltage of the external input power supply is in general 220V, and 220V can be taken as the reference voltage. When a drop of the voltage of the external input power supply 200 received by the power supply detection circuit 110 exceeds 20% of 200V, it can be regarded that the external input power supply 200 starts to be powered down, that is, it is regarded that the external input power supply 200 is in the abnormal state. When the drop of the voltage of the external input power supply 200 received by the power supply detection circuit 110 does not exceed 20% of 200V, it can be regarded that the external input power supply 200 is in the normal state.

Figure 3:
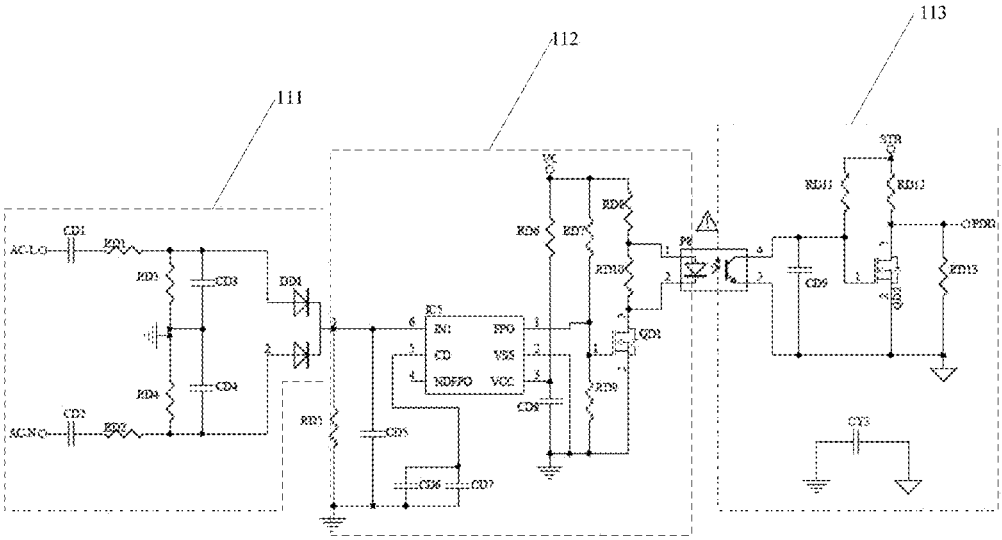
FIG. 3 is a schematic diagram of a specific circuit of a power supply detection circuit in a driving circuit in an embodiment of the present disclosure.

FIG. 3 schematically shows the circuit structure of the input unit 111, the detection unit 112 and the output unit 113 in the power supply detection circuit 110. The circuit structure is just illustrated for description. In the actual application, a circuit structure can be taken as the power supply detection circuit only if it can realize functions of the above units.

As shown in FIG. 1, the driving circuit 100 in the embodiment of the present disclosure can generally comprise: a power supply circuit 130 configured to convert the received alternating current voltage of the external input power supply 200 into a direct current voltage required by respective circuits in the driving circuit 100 and then provide power supply for the circuits. At present, the external input power supply 200 is input generally the alternating current voltage of 220V, and the power supply circuit 130 can convert the alternating current voltage into the direct current voltage of several channels and output it to a corresponding circuit in the driving circuit to provide power supply for the circuit. In addition, there are relatively large capacitors and inductive coils in the power supply circuit 130 generally. When the alternating current voltage of the external input power supply 200 starts to be powered down, these components can make the output voltage VDD of the power supply circuit 130 maintained normal for a period of time, so that the driving circuit 100 can operate temporally.

For example, in order to raise integration level of the driving circuit, in the actual operation, as shown in FIG. 1, the power supply detection circuit 110 can be integrated in the power supply circuit 130, that is, the power supply detection circuit 110 is manufactured in the same circuit board as a newly added module of the power supply circuit 130. In this way, the utilization rate of the circuit board can be raised, which is advantageous for reducing the number of components in the display devise.

As shown in FIG. 1, the driving circuit 100 in the embodiment of the present disclosure can generally comprise: a system circuit 140 configured to receive an external video signal, convert the external video signal into video data and then output it to the clock control circuit 120. After receiving the video data send by the system circuit, the clock control circuit 120 forms image data through a series of algorithms and processes. When the clock control circuit 120 receives the normal signal of power supply detection, the image data is directly sent to the organic light emitting display panel to be displayed.

Figure 4:
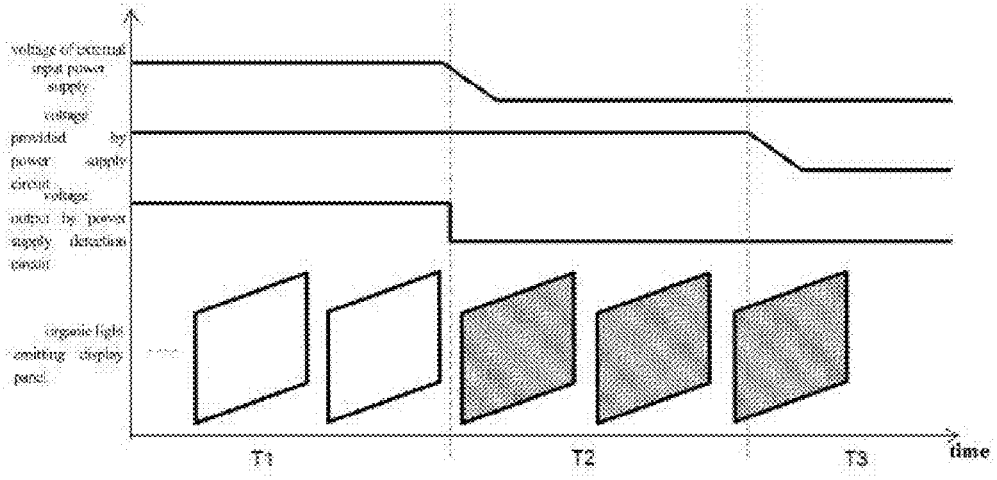
FIG. 4 is a schematic diagram of operations in respective phases of a driving circuit in an embodiment of the present disclosure.

FIG. 4 schematically shows a complete operating process of the driving circuit 100 in the embodiment of the present disclosure from normal operation to power-down. For example, this operating process can be divided into following three phases:

A first phase T1: the external input power supply 200 operates normally, and the power supply circuit 130 provides a normal direct current voltage VDD to the system circuit 140 and the clock control circuit 120. At this time, the power supply detection circuit 110 detects that the operating state of the external input power supply 200 is normal, and sends the high level LVTTL signal to the clock control circuit 120. When receiving the high level LVTTL signal, the clock control circuit 120 converts the video data sent by the system circuit 140 into image data and then sends it to the organic light emitting display panel 300 to be displayed normally.

A second phase T2: abnormality occurs to the external input power supply 200, and the drop of the input voltage exceeds 20% of 200V. The power supply circuit 130 has a relatively large capacitor and inductive coil, so that the power supply circuit 130 can provide the normal direct current voltage VDD to the system circuit 140 and the clock control circuit 120. At this time, the power supply detection circuit 110 detects that the operating state of the external input power supply 200 is abnormal, and send the low level LVTTL signal to the clock control circuit 120. When receiving the low level LVTTL signal, the clock control circuit 120 outputs image data of the black picture so that the organic light emitting display panel 300 displays the black picture. When displaying the black picture image, the organic light emitting display panel 300 can release the pixel charges accumulated on the respective display pixels, so as to avoid the transistors inside the display pixels from producing stress.

A third phase T3: due to power-down, the final input voltage of the external input power supply 200 is 0V, it is not enough for the power supply circuit 130 to maintain providing the normal direct current voltage VDD to the system circuit 140 and the clock control circuit 120. That is, VDD starts to drop to 0V, the system circuit 140 and the clock control circuit 120 stop operating, and the organic light emitting display panel 300 suffers a black screen.

It can be seen from the operating process of the above driving circuit that when the power supply circuit 130 can output the normal direct current voltage VDD in the second phase, the organic light emitting display panel 300 has started to display the black picture. In this way, it can ensure that the organic light emitting display panel 300 display the black picture when the clock control circuit 120 cannot operate, which avoids the problem of image sticking.

Based on the same inventive concept, the embodiments of the present disclosure further provide an organic light emitting display apparatus comprising the organic light emitting display panel and the driving apparatus of the organic light emitting display panel in the embodiments of the present disclosure. The display apparatus can be any product or components having the display function, such as a mobile phone, a tablet computer, a television, a display, a notebook computer, a digital photo frame, a navigator and so on. The implementation of the display apparatus can refer to the embodiments of the driving circuit, and thus no further description is given repetitively herein.

In the driving circuit of the organic light emitting display panel and the organic light emitting display apparatus of the embodiments of the present disclosure, it is indicated that voltage of the external input power supply starts to be powered down when the power supply detection circuit detects that the operating state of the external input power supply is the abnormal state. Due to hysteresis of power supply of the driving circuit, the driving circuit will be maintained operating normally for a short period of time, and at this time the power supply detection circuit outputs the abnormal signal of power supply detection to the clock control circuit. The clock control circuit changes from sending normal image data to the organic light emitting display panel into sending black picture image data to the organic light emitting display panel after receiving the abnormal signal. The organic light emitting display panel can release pixel charges accumulated on respective display pixels when displaying the black picture image, which avoids transistors inside the display pixels from producing stress, and finally avoids occurrence of shutdown image sticking due to power-down.

Obviously, those skilled in the art can make various amendments and modifications to the embodiments of the present disclosure without departing from the spirit and scope of the present disclosure. As such, if these amendments and modifications of the present disclosure fall into the scope of the claims of the specification as well as equivalents thereof, the present disclosure intends to include these amendments and modifications.

The present application claims the priority of a Chinese patent application No. 201410240219.9 filed on May 30, 2014. Herein, the content disclosed by the Chinese patent application is incorporated in full by reference as a part of the present disclosure.

What is claimed is:

1. A driving circuit of an organic light emitting display panel, comprising:

a power supply detection circuit configured to detect an operating state of an external input power supply, send a normal signal of power supply detection when it is determined that the external input power supply is in a normal state, and send a abnormal signal of power supply detection when it is determined that the external input power supply is in an abnormal state;

a clock control circuit configured to convert a received video data into image data recognizable by the organic light emitting display panel and then output it to the organic light emitting display panel when the normal signal of power supply detection sent by the power supply detection circuit is received, and output image data of black picture to the organic light emitting display panel when the abnormal signal of power supply detection sent by the power supply detection circuit is received, wherein the power supply detection circuit comprises:

an input unit configured to obtain an alternating current voltage of the external input power supply and perform rectifying process on the alternating current voltage of the external input power supply;

a detection unit configured to detect an operating state of the alternating current voltage of the external input power supply processed by the input unit;

an output unit configured to send the normal signal of power supply detection to the clock control circuit when the detection unit determines that the external input power supply is in the normal state, and send the abnormal signal of power supply detection to the clock control circuit when the detection unit determines that the external input power supply is in the abnormal state.

2. The driving circuit according to claim 1, wherein the detection unit is configured to determine that the external input power supply is in the normal state when a ratio of a voltage value of the external input power supply to a reference voltage value is greater than a predetermined threshold value, and determine that the external input power supply is in the abnormal state when the ratio of the voltage value of the external input power supply to the reference voltage value is not greater than the predetermined threshold value.

3. The driving circuit according to claim 2, wherein the predetermined threshold value set in the detection unit is 0.6-0.85.

4. The driving circuit according to claim 2, further comprising: a power supply circuit configured to provide power supply for respective circuits in the driving circuit after converting the received alternating current voltage of the external input power supply into a direct current voltage required by the respective circuits.

5. The driving circuit according to claim 2, further comprising: a system circuit configured to receive an external video signal, convert the external video signal into video data and then output it to the clock control circuit.

6. The driving circuit according to claim 1, wherein the normal signal of power supply detection and the abnormal signal of power supply detection output by the output unit are LVTTL signals.

7. The driving circuit according to claim 1, further comprising: a power supply circuit configured to provide power supply for respective circuits in the driving circuit after converting a received alternating current voltage of the external input power supply into a direct current voltage required by the respective circuits.

8. The driving circuit according to claim 7, wherein the power supply detection circuit is integrated in the power supply circuit.

9. The driving circuit according to claim 1, further comprising: a system circuit configured to receive an external video signal, convert the external video signal into video data and then output it to the clock control circuit.

10. An organic light emitting display apparatus comprising the organic light emitting display panel and the driving circuit of the organic light emitting display panel according to claim 1.

11. The display apparatus according to claim 10, wherein the detection unit is configured to determine that the external input power supply is in the normal state when a ratio of a voltage value of the external input power supply to a reference voltage value is greater than a predetermined threshold value, and determine that the external input power supply is in the abnormal state when the ratio of the voltage value of the external input power supply to the reference voltage value is not greater than the predetermined threshold value.

12. The display apparatus according to claim 11, wherein the predetermined threshold value set in the detection unit is 0.6-0.85.

13. The display apparatus according to claim 10, wherein the normal signal of power supply detection and the abnormal signal of power supply detection output by the output unit are LVTTL signals.

14. The display apparatus according to claim 10, further comprising: a power supply circuit configured to provide power supply for respective circuits in the driving circuit after converting a received alternating current voltage of the external input power supply into a direct current voltage required by the respective circuits.

15. The display apparatus according to claim 14, wherein the power supply detection circuit is integrated in the power supply circuit.

16. The display apparatus according to claim 10, further comprising: a system circuit configured to receive an external video signal, convert the external video signal into video data and then output it to the clock control circuit.

* * * * *